US009505469B2

(12) United States Patent
Valtanen

(10) Patent No.: US 9,505,469 B2
(45) Date of Patent: Nov. 29, 2016

(54) CONTROLLING SYSTEM AND METHOD FOR CONTROLLING A FLOATING ARRANGEMENT

(71) Applicant: Jarkko Valtanen, Helsinki (FI)

(72) Inventor: Jarkko Valtanen, Helsinki (FI)

(73) Assignee: Nextbase Offshore Oy, Helsinki (FI)

( * ) Notice: Subject to any disclaimer, the term of this patent is extended or adjusted under 35 U.S.C. 154(b) by 0 days.

(21) Appl. No.: 14/957,859

(22) Filed: Dec. 3, 2015

(65) Prior Publication Data

US 2016/0083054 A1 Mar. 24, 2016

Related U.S. Application Data

(63) Continuation of application No. PCT/FI2014/050446, filed on Jun. 3, 2014.

(30) Foreign Application Priority Data

Jun. 3, 2013 (FI) ..... 20135616

(51) Int. Cl.
*B63B 35/44* (2006.01)
*B63B 35/34* (2006.01)
(Continued)

(52) U.S. Cl.
CPC ..... *B63B 35/44* (2013.01); *B63B 35/34* (2013.01); *B63B 39/03* (2013.01); *B65D 88/54* (2013.01); *B65D 88/78* (2013.01); *B65D 90/12* (2013.01); *B65D 90/48* (2013.01); *E02B 3/06* (2013.01); *E02B 3/064* (2013.01); *B63B 2035/4486* (2013.01); *B65D 2590/0083* (2013.01)

(58) Field of Classification Search
CPC .. G05D 1/0206; B63H 21/213; B63H 21/22; B63H 25/42; B63B 49/00
See application file for complete search history.

(56) References Cited

U.S. PATENT DOCUMENTS 6,058,869 A 5/2000 Thon
2008/0078319 A1* 4/2008 Hebden ..... E02B 3/20 114/263

(Continued)

FOREIGN PATENT DOCUMENTS

DE 4233526 A1 4/1994
FR 2621004 A1 9/1987

(Continued)

OTHER PUBLICATIONS

Finnish Patent and Registration Office, dated Mar. 26, 2014 Search report for FI20135616.

*Primary Examiner* — Jelani Smith
(74) *Attorney, Agent, or Firm* — Berggren, Inc.

(57) ABSTRACT

A controlling system is used for controlling a state of a floating arrangement comprising plurality of containers, such as shipping or standard freight containers, especially consistent with ISO standard. At least some of the containers comprise a float arrangement having e.g. intra-container water-displacing volumes, such as an inflatable bag, which can be used for displacing water from the container when the inflatable bag is filled or for letting more water entering into the container when the inflatable bag is emptied, and thereby manipulating the buoyancy or draft of the container and thus also the same of the pontoon platform comprising said container(s). The state of the container and thus the floating arrangement can be controlled by operating the float arrangement by the controlling system, such as manipulating the inflatable bags or other state changing means of the float arrangement, such as propellers or supporting means.

20 Claims, 6 Drawing Sheets

(51) Int. Cl.

| | |
|---|---|
| ***B63B 39/03*** | (2006.01) |
| ***B65D 88/78*** | (2006.01) |
| ***B65D 90/12*** | (2006.01) |
| ***E02B 3/06*** | (2006.01) |
| ***B65D 88/54*** | (2006.01) |
| ***B65D 90/48*** | (2006.01) |

(56) References Cited

U.S. PATENT DOCUMENTS

2011/0074155 A1* 3/2011 Scholte-Wassink .... E02D 27/50 290/44
2013/0239870 A1* 9/2013 Hudson ..... B63G 8/001 114/333
2015/0115613 A1* 4/2015 Hayman ..... B63B 21/26 290/54

FOREIGN PATENT DOCUMENTS

| | | | |
|---|---|---|---|
| GB | 974576 | A | 11/1964 |
| JP | 62236910 | A | 10/1987 |
| JP | S6460494 | A | 3/1989 |
| JP | 2005271673 | A | 10/2005 |
| NL | 2001572 | C2 | 11/2009 |

* cited by examiner

CONTROLLING SYSTEM AND METHOD FOR CONTROLLING A FLOATING ARRANGEMENT

PRIORITY

This is continuation application of international application number PCT/FI2014/050446 filed on Jun. 3, 2014 and claiming priority of Finnish national application number FI20135616 filed on Jun. 3, 2013, the contents of both of which are incorporated herein by reference in their entirety.

TECHNICAL FIELD OF THE INVENTION

The invention relates to a controlling system and method for controlling a floating arrangement, such as a pontoon platform comprising at least one container or advantageously a plurality of interconnected containers. In particularly the invention relates to a controlling system and method for controlling a state of said arrangement.

BACKGROUND OF THE INVENTION

There is a need for building new constructions e.g. for substituting constructions lost or destroyed for example by earthquakes, natural catastrophe or the like. For example the earthquakes may destroy roads, bridges, buildings, harbours, airfields or other infrastructure completely. In addition after the natural catastrophe there is a great need for building new constructions, which might be a very demanding task, because often even boats are not able to docking and transport building material due to destroyed harbours. Anyway additionally there is also need for new construction for example to wet or swamp like or similar areas, where the new construction should be built very rapidly (often only for few years (meaning semi permanent)).

The invention relates to developing of constructions especially into the areas, where the infrastructure is destroyed by the natural catastrophe or the like, but also to areas for developing new buildings and constructions very rapid way, such as for temporary semi-permanent or permanent constructions, such as permanent or semi-permanent residential and commercial structures and buildings. Especially the invention relates to developing the constructions over the water area by using a pontoon platform and controlling a state of said platform, because for example tidewater or the like the state, such as positioning or draught of the pontoon platform arrangements are easily changed.

SUMMARY OF THE INVENTION

An object of the invention is to alleviate and eliminate the problems relating to the known prior art. Especially the object of the invention is to provide a control system for controlling a state of the floating arrangement, such as a pontoon platform comprising a plurality of interconnected containers so that it may remain its state e.g. due to wind, waves, tidewater or so that its state, such as location, position, alignment, tilt, angle of bank or displacement as an example, may be changed as desired.

The object of the invention can be achieved by the features of independent claims.

The invention relates to a controlling system according to claim 1. In addition the invention relates to controlling method according to claim 17.

According to an embodiment of the invention a controlling system is applied for controlling a state of a floating arrangement, such as pontoon platform, comprising at least one container, advantageously a plurality of floating modules or containers coupled or connected with each other. The containers are advantageously shipping or standard freight containers, especially consistent with ISO standard, such as ISO 668 (40 ft or 20 ft or the like) containers or RACE, ACTS, PODS, SECU or EILU containers, at least some of which are adapted to float on water, such that at least some of said containers are waterproof containers (floating as such) and/or at least some of the containers comprise a float arrangement. It is to be noted that also other types of containers or modules can also be utilized even if the containers are described in the embodiments. According to an example the containers are modified into a form of floating containers for example by sealing joints and gaps of the container in order to obstruct possible water flow into the container. As an example, also the doors of the container can be replaced by a fixed plate or the like so that a waterproof container is provided, which can float as such.

In addition according to an example the containers may be provided with an intra-container, such as an air inflatable bag, which water-displacing volume can be changed for displacing water from the container when the inflatable bag is filled or for letting more water entering into the container when the inflatable bag is emptied, and thereby manipulating the buoyancy or draft (draught) of the container and thus also the same of the pontoon platform comprising said container(s).

According to an embodiment of the invention the controlling system comprises controllable means for changing the state of at least one container of the floating arrangement and thereby also the state of the floating arrangement comprising said container. The controllable means are for example a controllable valve or vent, pump, a motor with a propeller or turbine, an anchoring system or other controllable means described in this document. The controlling system is advantageously configured to receive current state information related to at least one container, of the float arrangement or environmental state, such as wind, tidewater phase or the like as an example. In addition the controlling system is configured to compare said received state information to desired state information and based on the comparison provide control signal for at least to one controllable means to change the state of the container or arrangement towards said desired state, and again to operate the controllable means of the float arrangement based on said provided control information in order to achieve said desired state. According to an embodiment the controlling system may also receive controlling information (which is then used by the controlling system as said control signal) from a user interface means operated e.g. manually by a user, such as from joystick or the like, or from external systems, whereupon the state of at least one container of the floating arrangement and thereby also the state of the floating arrangement comprising said container can be controlled remotely.

According to an embodiment the floating arrangement comprises at least one intra-container water-displacing volume located in at least one container of the arrangement, and controllable means for changing capacity of at least one of the intra-container water-displacing volume. The intra-container water-displacing volume may be for example a gas- or foam-inflatable gas bag, such as an airbag. Alternatively or in additionally the float arrangement may also comprise a foaming means for at least partially filling an intra-container volume or container with water-displacing foam, for example a chemical agent reacting with water or other water-displacing medium, such as ping-pong balls or other particles or medium with density less than density of water.

According to an embodiment the controlling system is configured to operate the controllable means of the float arrangement based on the provided control information to change the capacity of at least one intra-container water-displacing volume and/or fill an inner volume of the container with water-displacing medium in order to achieve said desired state.

The controllable means may comprise for example a controlled valve or pump for pumping a fluid, such as gas into or out of the container and/or an inflatable bag provided inside the container, and/or for pumping water into or out of the interior of a container and/or said inflatable bag provided inside said container, and thereby manipulating the buoyancy, location, position, alignment, tilt, angle of bank or displacement of the container and thereby also the state of the floating arrangement comprising said container. According to an embodiment the container may comprise also a valve as a controllable means in connection with the inflatable bag, whereupon the controlling system may control the state of the container (e.g. buoyancy) and thereby the floating arrangement state by changing the bag capacity or water via operating said controllable means. When deflating the bag and thereby allowing water flow into the container, the buoyancy is decreased and the container is sink more; and conversely, when inflating the bag and thereby displacing water out of the container the buoyancy is increased and draft decreases (lifting the container higher in the water). The valve may also locate at the container's wall, whereupon the water flow via said valve can be manipulated by said controlling system by opening or closing said valve.

The container of the arrangement may comprise a plurality of the intra-container volumes, such as inflatable bags, which can be operated separately and independently of each other so that the bags located at the first end of the container can be filled differently than the bags located at the second end of the container, whereupon the buoyancy or draft of the container at the first end differs from the same at the second end thereby allowing a tilting or inclination function of the container. The controlling system then advantageously comprises in addition to plurality of the bags also a pump or the like and/or a controlled valve for supplying gas at least into one of the bags or for delivering water into/out of the container and thereby configured for adjusting the tilt, alignment, angle of bank or displacement of the container by means of different buoyancies in different parts of the container.

The containers, controllable means and measuring means for measuring the state information as an example may comprise a ID-means, preferably a wirelessly or remotely readable ID-means. In addition the system advantageously comprises database, where information is coupled with said IDs, such as location and type of the corresponding means. Thus the system may be provided with information related to said ID and location, where the container or the like with said ID locates, as well as information related to type of said container or the like, such as floating container with inflatable bag(s), valve, pump, actuating means, anchoring container, container with motor+propeller or the like as an example. The controlling system is then advantageously configured to determine based on said ID e.g. the location and type of said container in the database arrangement and thereby configured to provide appropriate control signal to particular containers in order to change or remain the state of the particular container and/or the arrangement.

In addition the containers or the arrangement may comprise measuring means for measuring the state of the container or the arrangement, such as a pressure gauge, load gauge, torque force meter, angle meter and/or positioning means, as an example, wherein the measurement of the measuring means is configured to be transferred to the controlling system advantageously with said container ID or location information of the location of said measuring means representing the state information related to said container or the arrangement so that the controlling system is able to receive said state information, compare it to desired state information and based on the comparison to provide control signal for at least to one controllable means to change the state of the container or arrangement, as is described elsewhere in this document.

One of the controllable means of the floating arrangement is the active anchoring system via which the controlling system is also configured to manage the state of the container(s) or the arrangement. The active anchoring system comprises controllable means, such as a piece of support equipment adapted to be variable in length and fitted between at least one floating container and the anchoring means, such as anchoring container or concrete body at the bottom. In this embodiment the controlling system is adapted to tilt the pontoon platform and thereby the floating arrangement e.g. by changing the length of the supporting means, such as winding the rope between the anchoring means and the container by a motor or hydraulically operating the supporting equipment when said supporting equipment is e.g. hydraulically operable supporting means. This is especially important in tidewater areas, whereupon the controlling system may compensate at least partially the tilting effects due to tidewaters by operating the active anchoring system as described above.

In addition the floating arrangement may comprise a) weight measuring equipment for determining a weight arriving on or departing from the floating arrangement, b) measuring equipment for draft or a distance to surface, c) measuring equipment for floating arrangement distortion and/or measuring equipment for wind direction/speed; and wherein said measurement data are configured to be transferred to the controlling system as said current state information related to at least one container, arrangement or the environment so that said controlling system is configured to provide said control information for at least to one controllable means to change the state of the arrangement towards said desired state, so as to achieve a desired draft, direction, displacement, distance to and/or inclination of the container or arrangement from the surface.

Furthermore the controlling system may be configured to control the state via a container comprising moving equipment (e.g. motor+propeller or turbine), by means of which the container or several containers or the floating arrangement is or are adapted to be balanced and/or moved in vertical and/or horizontal direction by the controlling system.

The floating arrangement may also comprise positioning devices, whereby, in response to a signal produced by said positioning devices, the controlling system is configured to control e.g. said moving equipment for enabling the floating arrangement either to remain stationary or to shift over a desired distance in a desired direction, e.g. in order to compensate for shifting caused for example by tidal currents or consistent wind. Alternatively, or in addition, the controlling system may be configured to receive said position information for example from an external system. The position information can be based on video, radar, satellite, laser beaming, depth/draft, radio signal information and/r combination of those, as an example.

The invention offers remarkable advantages over the known prior art solutions, namely at first, when using shipping or standard freight containers, there are essentially no need for transportation of the containers e.g. into the disaster area from outside or abroad, because there are always lots of shipping or standard freight containers all over the world in harbours and transportation, and in addition they are extended quite equally to coastal areas worldwide. For example in 2009 there were over 15 million ISO 668 (40 ft) containers in the transportation worldwide.

In addition the pontoon platform is very quick and easy to build of the standard containers because due to the standard they are very compatible with each other for example with dimensions and strength. Thus the inventive concept of the current invention makes possible to offer and give aid to the disaster area extremely quick, as well as to build essential constructions very easy, such as residential areas, apartments, hospitals, harbours, bridges, a logistics arrangements or airfields.

Furthermore, according to the invention it is also possible to construct a flight support arrangements or military or social infrastructural arrangements, a jetty, a utility work machine platform, a drilling derrick, a bridge building site, temporary structures, a pontoon bridge or a bridge support structures over the pontoon platform constructed from the containers, as is described in this document. Also there is no need for prefabricate containers or store them beforehand, whereupon significant savings can be achieved. The invention enables to achieve a standard construction method of how globally temporary and permanent floating platforms can be made and thereby helps to organize international aid work, for example. In addition permanent and semi permanent residential and commercial structures and buildings can easily be constructed according to the embodiments of the invention. One possible destination is also to construct a floating farming or plant grooving platforms. Especially many advantages can be achieved when the platforms are constructed over the water since the free land area is very expensive especially in the vicinity of big cities.

Especially according to the invention the state of the on container or even the overall system comprising plurality of containers can be controlled and thereby preventing for example distortions or misalignments due to unbalanced loadings, winding or rough sea or weather conditions.

BRIEF DESCRIPTION OF THE DRAWINGS

Next the invention will be described in greater detail with reference to exemplary embodiments in accordance with the accompanying drawings, in which.

DETAILED DESCRIPTION

Figure 1A:
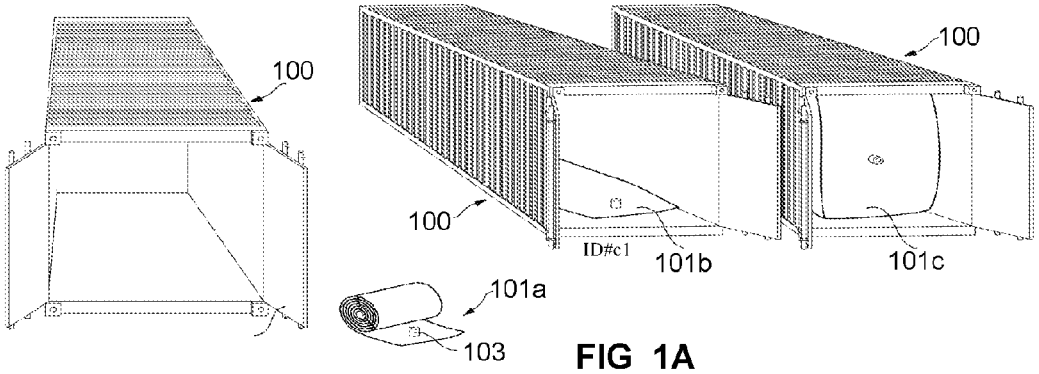
FIGS. 1A-1C illustrate a principle of an exemplary containers for a pontoon platform a state of which is to be controlled according to an advantageous embodiment of the invention, FIG. 2 illustrate exemplary embodiments for anchoring and stabilizing the pontoon platform according to an advantageous embodiment of the invention.
Figure 1B:
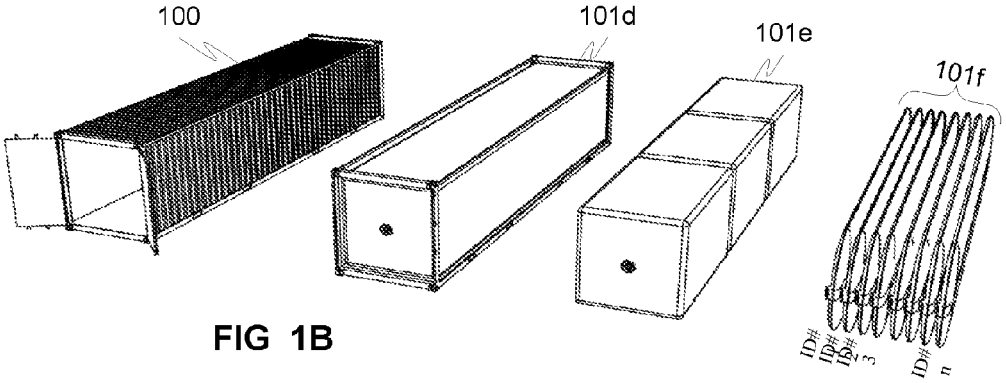
Figure 1C:
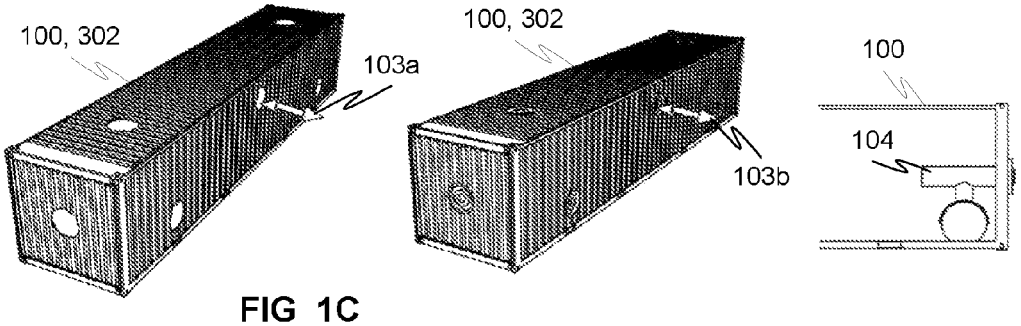

FIGS. 1A-1C illustrate a principle of an exemplary containers 100 for a pontoon platform according to an advantageous embodiment of the invention, where at least some of the containers comprises a controllable float arrangement 101*a*-101*f*. The controllable float arrangement comprises according to an embodiment at least one intra-container water-displacing volume 101*a*-101*f* (for example a gas-inflatable or foam-inflatable gas bag), as well as a vent, valve 103, 103*a*, 103*b* and/or pump 104 being operationally connected with said containers 100 and/or intra-container 101*a*-101*f* (such as the bag) so that the water-displacing volume can be manipulated by the controlling system of the invention by controlling the operation of said vent, valve and/or pump and thereby change or remain the state of the container(s) or arrangement. The pump may be configured to pump air or other fluid into/out of the bags, and/or to pump water other fluid into/out of the container.

The valve or vent 103, 103*a*, 103*b* may be controllable so that it can be opened or closed for example to deflate the airbag 101*a*-101*f*. Also the pump or the like can be used for providing filling medium into the intra-container water-displacing volume 101*a*-101*f*, such as air into the airbag via said valve or vent 103, 103*a*, 103*b* and thereby providing the floating container. When deflating the bag and thereby allowing water flow into the container, the buoyancy is decreased and the container is sink more; and conversely, when inflating the bag and thereby displacing water out of the container the buoyancy is increased and draft decreases (lifting the container higher in the water).

By controlling the water-displacing volume of the intra-container, the buoyancy and draft of the container and thereby also the same of the pontoon platform arrangement can be controlled. The float arrangements 101*a*-101*f*, like the bags, as well as also the containers and the valves, vents and pumps may have own IDs, whereupon the controlling system can provide controlling signal to an appropriate means, such as a pump or valve connected with a certain container in order to manipulate the state of that particular container. Advantageously the controlling system can determine location and type of the particular means based on said ID for example via help of database system, where the ID can be coupled with said other more detailed information, such as type and location of the means.

According to an embodiment the container 100 may also comprise the vent 103*a* via which the water can freely flow into/out of the container, whereupon the stabilizing container 202 can be achieved. The container 100 may also comprise the valve 103*b* for controlling the flow of the water into/out of the container 100. Still according to an embodiment the pump 104 may be configured to pump water into the container e.g. in order to decrease buoyancy or to pump water out of the container 100 (or at least portion of the container) in order to increase buoyancy. Still according to an embodiment the operation of the vent 103*a*, valve 103*b* and the pump 104 of the each container can be controlled advantageously independently of each other by the controlling system.

Figure 2:
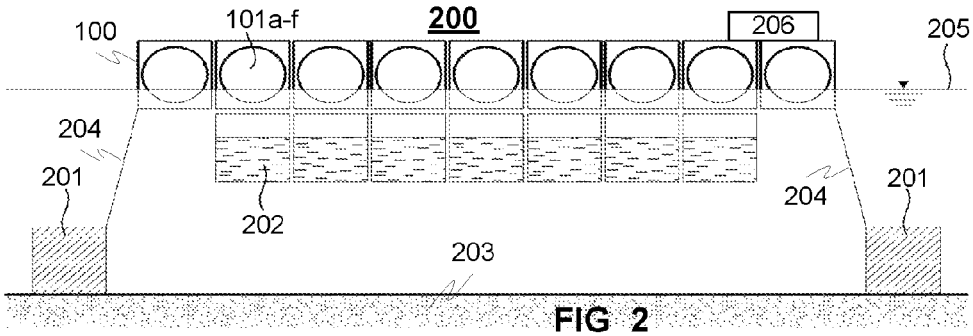

FIG. 2 illustrates exemplary embodiments for anchoring and/or stabilizing the pontoon platform 200 according to an advantageous embodiment of the invention, where some of the containers 100 may function as anchoring containers 201, and some of the containers 100 may function as stabilizing containers 202. The anchoring containers 201 may be filled by water, sand or other medium so that the containers sink to the bottom 203. The water may be pumped into the container by the pump 104 for example, or the container may comprise vent 103*a* or valve 103*b* for flowing water into the container and thereby make the container as the anchoring or stabilizing container 202. The floating portion of the arrangement 200 is advantageously coupled with the anchoring containers 201 by suitable connecting means 204, such as wires, the length of which can be advantageously controlled by the controlling system 206 of the invention, as is described in more details in connection with FIG. 3A. The pontoon platform arrangement may also comprise other supporting means, such as supporting rods or bars elongating to the bottom the length of which or the position of the container in respect of said supporting means can be advantageously controlled by the controlling system of the invention (as is illustrated e.g. in FIGS. 3B-3F). Additionally the connecting means 204 may be connected to any other connecting points arranged into an appropriate location at the bottom, such as an external anchor or a concrete spacer block 301 or the like, as is described e.g. in FIGS. 3A-3F.

According to an embodiment the connecting means 204 is as an elongated member, the first point of which is supported at the bottom 203 of the water by anchoring means, such as the external anchor or a concrete spacer block, or anchoring container 201. In addition the second point of the elongated member is coupled with the platform structure, such as a container 100. The anchoring system is according to an embodiment of the invention the active anchoring system additionally comprising actuating means 302, 307 configured to change the distance of at least one end of the container 100 of the platform from the bottom 203 or the water surface 205 by actuating said elongated member 204. The elongated member 204 may be a wire, chain or rope (as in FIG. 3A) or fixed elongated member (as in FIGS. 3B-3F) According to an example the system may change the distance of at least one end of the container, such as tilt the pontoon platform or wherein the elongated member is fixed in length and the actuating means is configured to change the position of the at least one end of the container in relation to said fixed elongated member.

Figure 3A:
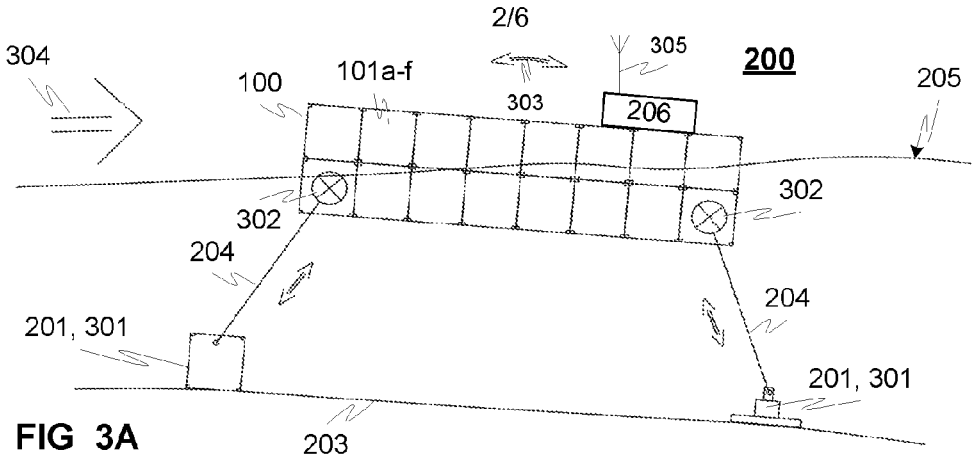
FIGS. 3A-3F illustrate exemplary embodiments for controlling a state of the pontoon platform according to an advantageous embodiment of the invention.
Figure 3B:
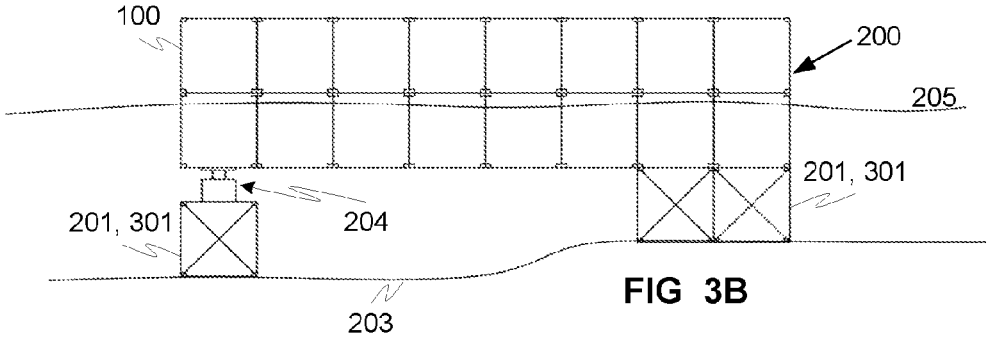
Figure 3C:
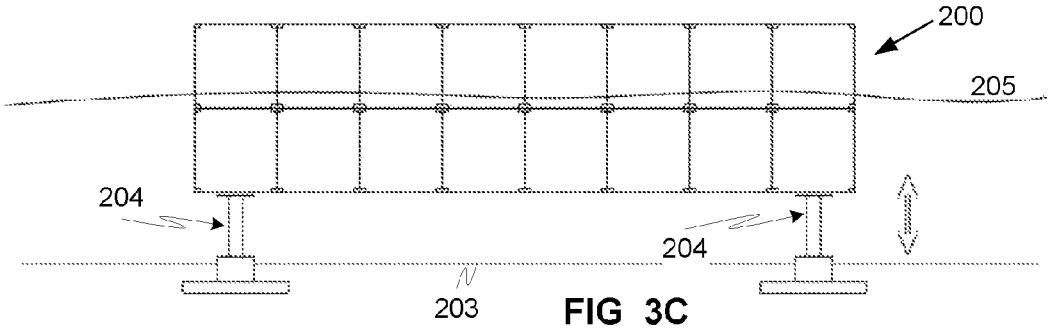
Figure 3D:
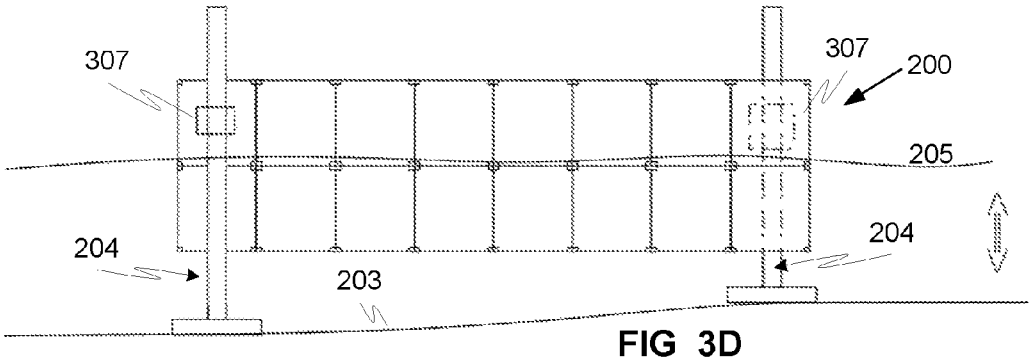
Figure 3E:
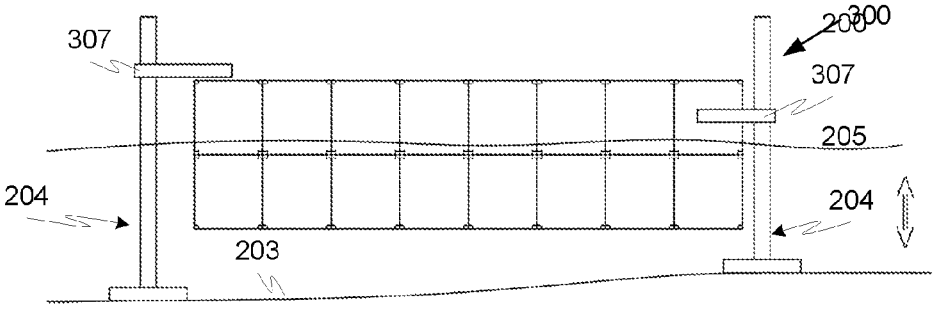
Figure 3F:
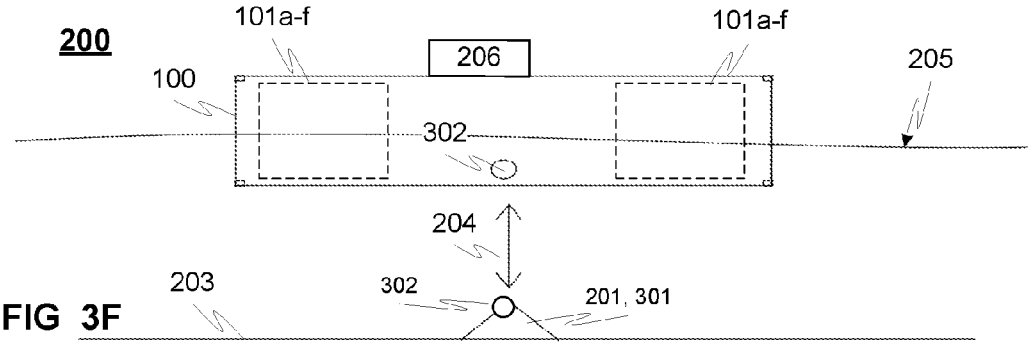

It is to be noted that the pontoon platform 200 may rest to the bottom 203 directly and fixedly via its one end (for example using anchoring containers) whereupon the other end of the container is supported to the bottom via the controllable supporting means 204 (as is described in FIG. 3B). In addition it is to be noted that the controllable supporting means 204 may be implemented in various way, as is demonstrated in FIGS. 3A-3F, where the supporting means may be a chain or the like, which can be reeled up, or a fixed type supporting means, such as a hydraulically operated cylinder with variable length or a rod type means with a fixed length whereupon the position of the container is varied in relation to said fixed length.

The stabilizing container 202 may be provided with at least one vent at a specific height of the container wall, which may be a vent the opening of which can be controllable by the controlling system. As an example the container 202 space above said vent may be made airtight in such a way that, when water is let in through said vent and the container space above the vent is left with an air lock preventing the container from being completely filled with water, which allows an exemplary passive stabilization. The stabilizing container 202 may also be filled completely with water and coupled in a fixed manner with the floating containers 100 in order to increase the mass and thereby inertia of the floating system 200 and thereby more effectively suppressing any possible motions or oscillation for example due to waves of the water 205. In addition water flowing freely into and from the container via the vent damps and thereby stabilizes the motions of the container 202.

According to an embodiment the stabilizing containers 202 may also comprise the intra-container water-displacing volume 101*a*-101*f*, which volume can be controlled by the controlling system as described elsewhere in this document, and thereby the buoyancy and thereby the pontoon platform draft are adapted for being regulated by changing the gas bag capacity.

FIGS. 3A-3F illustrate exemplary embodiments for controlling a state of the pontoon platform 200 according to an advantageous embodiment of the invention, wherein in FIG. 3A the pontoon platform 200 is anchored at the bottom 203 via supporting means 204 the length of which can be varied by the actuating means, such as a controllable motor 302, the operation of which can be controlled by the control system 206. For example the tilt angle 303 of the pontoon platform 200 can be changed according to wind conditions, for example, such as by winding the rope 204 at the windward side and releasing the rope 204 at the other side whereupon the effect of the wind 304 can be minimized.

The controlling system 206 of the invention may receive for example weather forecast information from weather stations or wind direction and speed information from a windspeed meter 305 or other position information e.g. from GPS device or the like, based on which the controlling system 206 is configured to provide control signal to the controllable motor 302 for varying the length of the supporting means 204 in order to remain or change the state of the container or the platform. It is to be noted that the controllable motor 302 may be situated on the container 101 as is described, but also at the bottom or somewhere in connection with the supporting means 204 so that it is able to operate said supporting means 204.

According to an embodiment the pontoon platform 200 or a container 100 may be anchored only from one point (FIG. 3F), whereupon the overall displacement or draught (draft) can be controlled by the controlling system 206 by operating the length of the corresponding supporting means 204. In this embodiment the alignment, tilt or angle of bank of the container or the pontoon platform 200 can be adjusted e.g. by controlling buoyant force of the controllable float arrangements 101*a*-101*f*, such as intra-container water-displacing volumes 101*a*-101*f* arranged in different portions of the container 100 or in different containers of the platform 200 (as is described in FIG. 3F or FIG. 8A, as an example).

Figure 4:
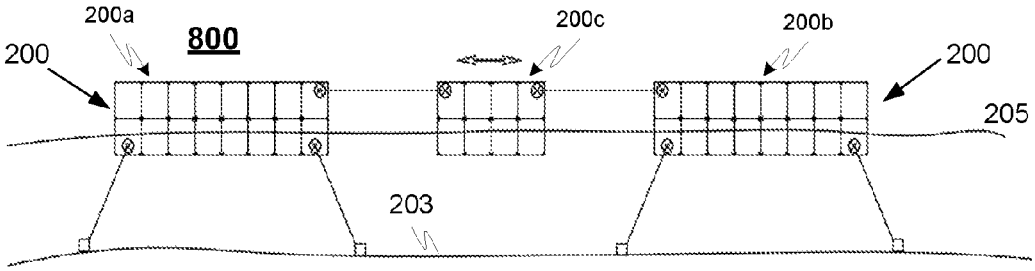
FIG. 4 illustrates an exemplary pontoon platform arrangement according to an advantageous embodiment of the invention.

FIG. 4 illustrates an exemplary pontoon platform arrangement 800 according to an advantageous embodiment of the invention, where the platform 200 may comprise a plurality of sub-arrangements 200*a*, 200*b*, between which another movable pontoon platform arrangement 200*c* is arranged. According to an embodiment the moving pontoon platform 200*c* may also be arranged between any floating pontoon platform 200 and ground, shore, island, boat or any other end. The moving pontoon platform 200*c* is connected to the other arrangements 200*a*, 200*b* or any other end e.g. by a motorized wire so that the moving pontoon platform 200*c* can be towed by the motorized wire to the desired direction, the operation of which is advantageously controlled by the controlling system 206. The sub-arrangements 200*a*, 200*b* may be floating arrangements and possibly anchored and stabilized, as is described elsewhere in this document.

Figure 5:
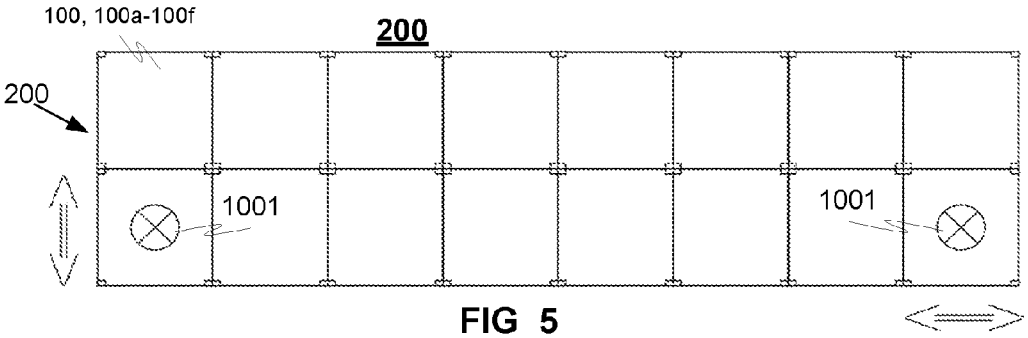
FIG. 5 illustrates an exemplary pontoon platform arrangement with moving equipment according to an advantageous embodiment of the invention.
Figure 6A:
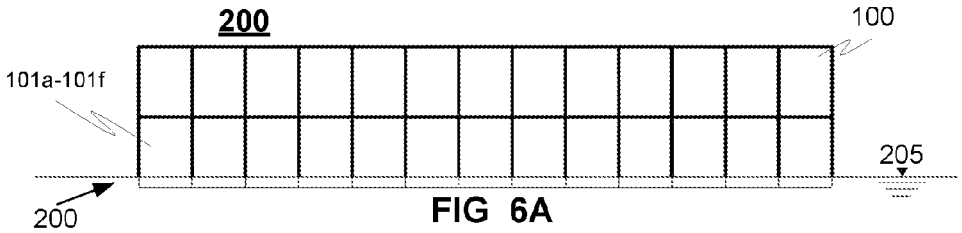
FIGS. 6A-6D illustrate exemplary embodiments for controlling a state of the pontoon platform, such as for a harbour or movable harbour, according to an advantageous embodiment of the invention.
Figure 6B:
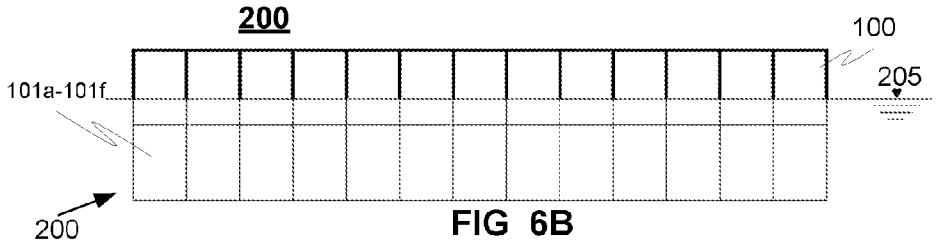
Figure 6C:
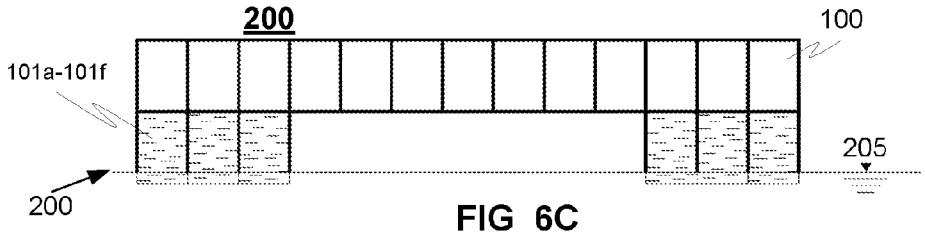
Figure 6D:
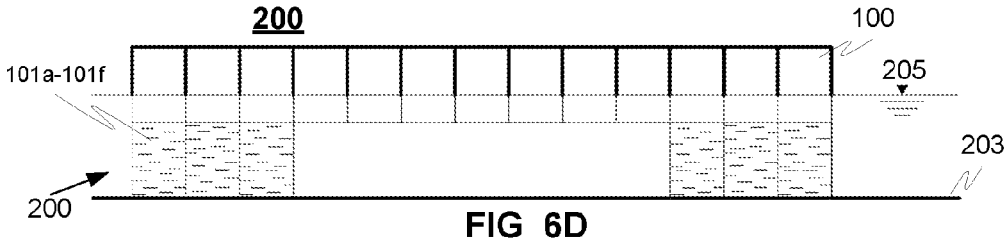

FIG. 5 illustrates an exemplary pontoon platform arrangement 200 with moving equipment 1001 according to an advantageous embodiment of the invention, wherein the moving equipment 1001 may be a motor with a suitable propeller or turbine or the like, as an example, which is suitable for moving the pontoon platform arrangement 200 in the water either horizontally and/or vertically (when the buoyancy of the pontoon platform arrangement 200 is suitably controlled by the controlling system described in this document elsewhere so that e.g. the displacement or draft is suitable for moving). For example the controlling system may be configured to change the state of the pontoon platform 200 by controlling the operation of the moving equipment 1001, such as situation or angle in relation to sun so that a certain part or side of the pontoon platform 300 is always towards to sunshine or always in the shadow.

FIGS. 6A-6D illustrate exemplary embodiments for controlling a state of the pontoon platform 200, such as a harbour, movable harbour structure, a flight support arrangement or some other military or social infrastructural arrangement, a jetty, a utility work machine platform, a drilling derrick, a bridge building site, a temporary structure or the like according to an advantageous embodiment of the invention, where the embodiments utilizes the floating pontoon platforms 200 described elsewhere in this document. The arrangement advantageously comprises the floating containers 100 provided with the floating arrangements 101*a*-101*f* according to the embodiments of the invention. In addition the arrangement may also comprise the stabilizing containers 202 or containers the buoyancy of which are controllable by the controlling system 206 (as described elsewhere in this document) so that the containers may be converted for example into the anchoring containers 201 e.g. by controlling the water flow into the containers 201 so that they sink to the bottom 203.

According to an exemplary embodiment the pontoon platform 200 may be moved along the water e.g. by displacing water from the containers 100 (FIG. 4A) by appropriately controlling by the controlling system 206. When the pontoon platform 200 is at a desired position (e.g. GPS device may be utilized or position information received somewhere else, for example externally) the water may be controlled to flow into the containers 100, 202 so that the platform 200 is stabilised (FIG. 6B, FIG. 6C) and possibly also anchored (FIG. 6D) at least partially. Again if there is need to move the pontoon platform 200 the floating arrangements 101*a*-101*f* may be applied and controlled as described in this document to increase buoyancy and to enabling the moving. According to an embodiment the pontoon platform 200 may also comprise at least one transferring container having transferring means for moving the arrangement or platform, such as power source and suitable propeller or the like the operation of which can be controlled by the controlling system 206, correspondingly.

Figure 7:
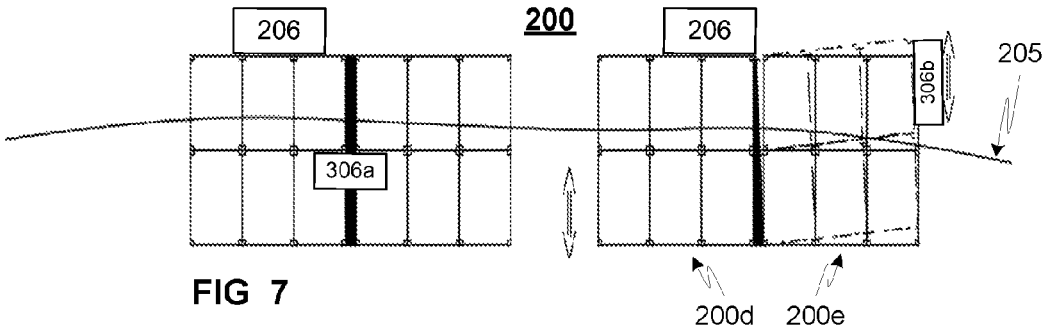
FIG. 7 illustrates an exemplary embodiment for controlling a state of the pontoon platform arrangement according to an advantageous embodiment of the invention.

FIG. 7 discloses an example, where the pontoon platform 200 comprises plurality of containers and controllable float arrangements 101*a*-101*f*, such as intra-container water-displacing volumes 101*a*-101*f* arranged in different containers. In addition the embodiment comprises gauges 306*a* for metering stress or bending or gauges 306*b* for metering distances or positions of different portions from the surface 205. Also the water-displacing volumes 101*a*-101*f* may comprise suitable meters such as pressure gauges. The controlling system 206 receives advantageously information also from the gauges 306*a*, 306*b* (together with location information or containers or means ID in responsible for controlling the state the meter in question is determining), whereupon the controlling system 206 is configured to provide appropriate control signals e.g. to the active anchoring systems (shown in FIGS. 3A-3F) and to the float arrangements 101*a*-101*f* in order to remain or change the state of certain containers and therefore also of the platform to compensate for example the stress, bending, distances or positions or high of said containers in questions and/or the overall pontoon platform arrangement.

As an example the gauges utilized may provide information representing that the most right portion tends to bend upwardly (e.g. due to waves or tidewater or whatever reason), based on which the controlling system 206 may compare the received information (e.g. stress information or high information) to state information set beforehand and based on this provide control signals to the state changing equipment, such as controllable float arrangements 101*a*-101*f* in order to remain or change the state towards the desired one. For example in the situation in question in this example, the controlling system 206 may provide control signals to the container(s) located at the first portion 200*d* of the pontoon platform 200 to increase buoyant force or control signals to the container(s) located at the second portion 200*e* of the pontoon platform 200 to decrease buoyant force. The manipulating of buoyant force can be achieved as is described elsewhere in this document.

Advantageously the controllable float arrangements 101*a*-101*f*, such as inflatable bags, can be operated separately and independently of each other so that the bags located at the first end of the container or the pontoon platform can be filled differently than the bags located at the second end of the container, whereupon the buoyancy or draft of the container at the first end differs from the same at the second end thereby allowing a tilting or inclination function of the container. The systems then advantageously comprises in addition to plurality of bags also a pump or the like and/or a controlled valve for supplying gas at least into one of the bags or for delivering water into/out of the container and for thereby adjusting the tilt, alignment, angle of bank or displacement of the container by means of different buoyancies in different parts of the container, as is described in elsewhere in this document.

Figure 8A:
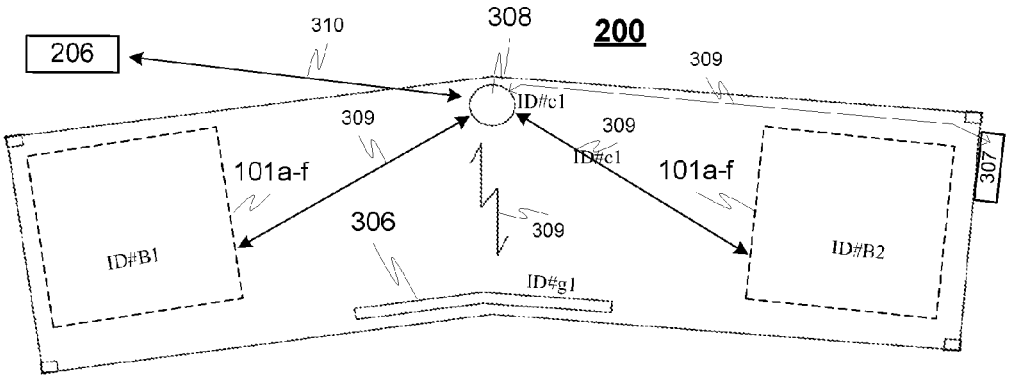
FIGS. 8A-8C illustrate an exemplary embodiment for controlling a state of the pontoon platform arrangement and data communication of the system according to an advantageous embodiment of the invention.
Figure 8B:
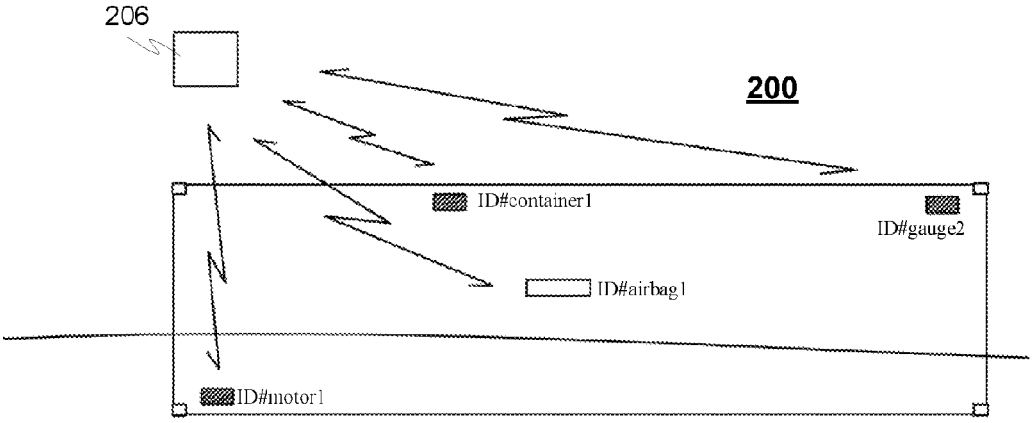
Figure 8C:
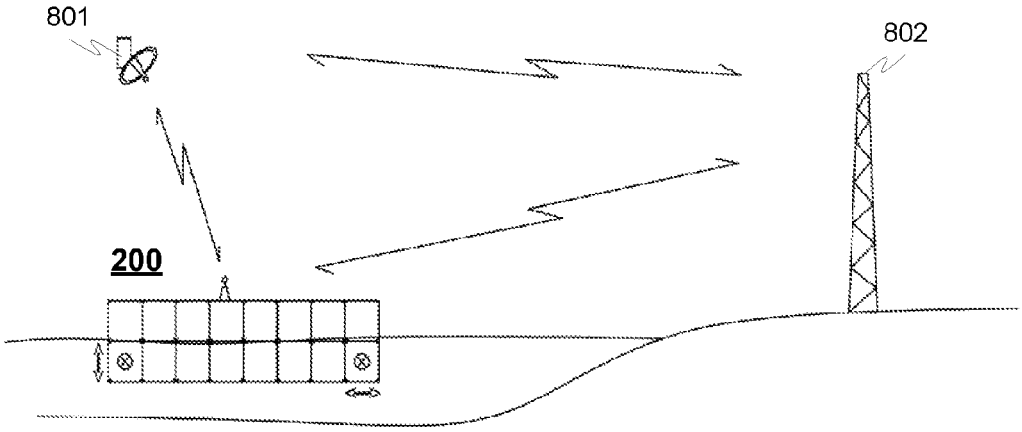

FIGS. 8A-8B illustrate in more details an example of information transferring, where the container may comprise a switching unit 308, such as a HUB, which is in data communication 309 with the gauges, such as gauges 306*a*, 306*b* for gathering measurement data and delivering it (advantageously with ID information of the container and gauge and the like) to the controlling system 206. The controlling system is advantageously configured to communicate 310 data, such as control signals, via the switching unit 308 to the appropriate controllable float arrangements 101*a*-101*f*. The data communication links 309, 310 may be implemented by the techniques known by the skilled person, such as by wirelessly or wired way. The data communication for transferrin measurement information as well as also controlling signals in the embodiment of the invention can be implemented correspondingly.

As can be seen in FIG. 8B the controlling system 206 may also be in data communication directly with the gauges and that the data communication is advantageously bidirectional. In addition the controlling system may either gather measurement data from the gauges and thereby, based on that, provide said control signals for controlling the state of the container or the floating arrangement, but the information used for providing control signal, such as position information or weather information as an example, can also be received from external sources 801, 802, such as from satellites, external control centre. Additionally also the control signal may be provided directly from external sources.

Figure 9A:
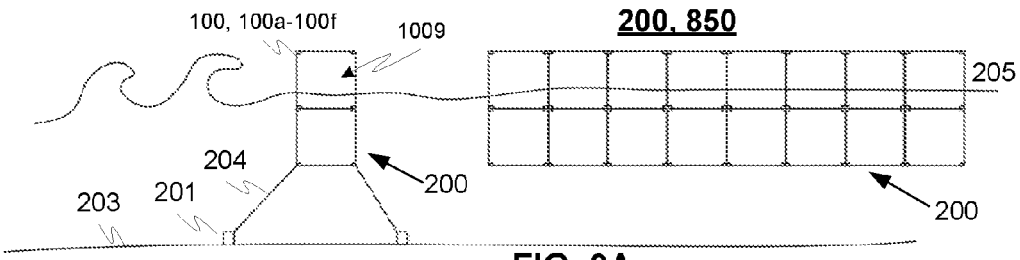
FIGS. 9A-9B illustrate exemplary breakwater arrangements according to an advantageous embodiment of the invention.
Figure 9B:
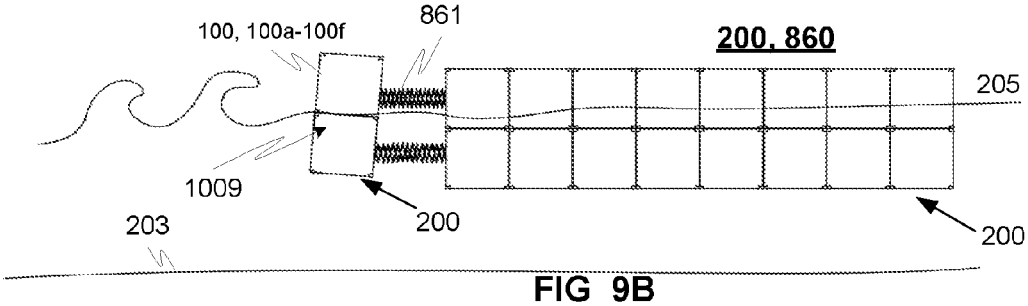

FIGS. 9A-9B illustrate exemplary breakwater arrangements 850, 860 according to an advantageous embodiment of the invention, where the floating pontoon platform arrangement 200 with its container(s), 1009 is used as a breakwater or jetty arrangement. The jetty or breakwater 1009 is advantageously located at a distance from the other floating pontoon platform arrangement 200 and the jetty or breakwater 1009 may be as an independent and separate pontoon platform arrangement possibly anchored at the bottom, as is the case in breakwater arrangement 850 in FIG. 9A, or mechanically coupled with the floating pontoon platform arrangement 1000 via a suspending system 861, such as a spring or shock damper, as is the case in breakwater arrangement 860 in FIG. 9B.

Figure 10:
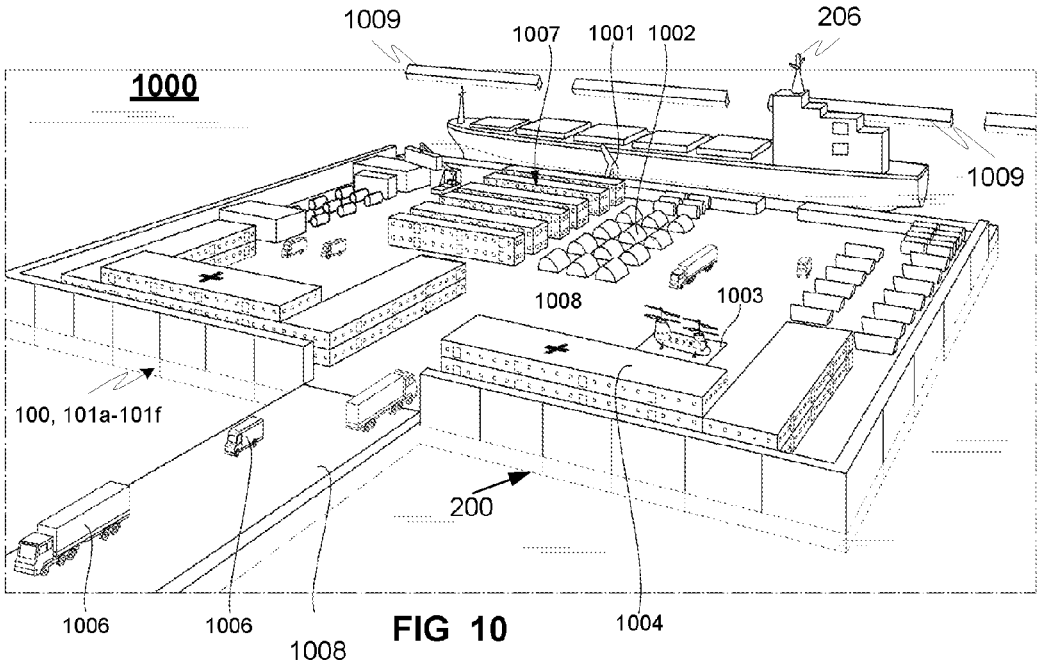
FIG. 10 illustrates an exemplary of the pontoon platform arrangement utilizing the controlling system according to an advantageous embodiment of the invention.

FIG. 10 illustrates an exemplary floating pontoon platform arrangement 1000 according to an advantageous embodiment of the invention, where the arrangement advantageously comprises the pontoon platform 200 and over it a constructed deck 1008. The arrangement may be, comprise or form at least portion of a harbor arrangement 1001, logistics arrangement 1002, a flight support arrangement 1003, medical or hospital arrangement 1004, bridge arrangement 1005 with a road for transportation 1006, or some other military or social infrastructural arrangement, such as apartments 1007. In addition the floating pontoon platform arrangement 1000 may comprise a jetty or breakwater 1009, which might be as a separate pontoon platform arrangement possibly anchored at the bottom, as described elsewhere in this document, or mechanically coupled with the pontoon platform arrangement 1000 via a suspending system, such as a spring or shock damper.

In addition the pontoon platform arrangement 1000 may also comprise according to an embodiment a utility work machine platform, a drilling derrick, a bridge building site, a temporary structure, a pontoon bridge and/or a bridge support structure. It is to be understood that these are only examples and the inventive concept can also be utilized in other pontoon platform arrangements 1000.

In addition it is to understood that the floating pontoon platform arrangement 1000 may comprise any of the pontoon platforms 200 with any auxiliary devices and especially the controlling system 206 for controlling the state of the floating arrangement described in this document to e.g. to provide the basis for the pontoon platform arrangement 1000 or maintain or change or otherwise control the state of the container 100, floating pontoon platform arrangement 200, 1000.

The invention has been explained above with reference to the aforementioned embodiments, and several advantages of the invention have been demonstrated. It is clear that the invention is not only restricted to these embodiments, but comprises all possible embodiments within the spirit and scope of the inventive thought and the following patent claims. For example, even if the gas bags or airbags are demonstrated in connection with many embodiments in this document as an example of the float arrangement for manipulating the state of the container and floating arrangement, it is clear that they are only examples of the float arrangement and intra-container water-displacing volumes utilized in the containers in order to provide controllable floating containers, and also other types of means utilized in the float arrangement can be used, such as controllable valves, vent, motors, propellers, turbines, supporting means or the like. In addition also other types of intra-container water-displacing volumes can be used with these embodiments, as is described in this document, such as foaming means for at least partially filling an intra-container volume or container with water-displacing foam, for example a chemical agent reacting with water or other water-displacing medium, such as ping-pong ball, or combination of these.

In addition it is to be noted that the controlling system may be operated by an operator via a user interface, such as using joystick(s) or other known UI devices. Moreover the controlling system may be operated by either on the board (floating arrangement) or externally. In addition the controlling system may function independently and based on the information gathered by it. Anyway, the controlling system may receive at least portion of the information used for providing the control signal from the gauges and meters being connected to the floating arrangement, such as from a pressure gauge located at the airbag or distance or stress gauge located at the container, but also it may also receive at least portion of that information from an external sources, such as from a control center, satellite, ships, base stations or the like, or combination of these above mentioned.

Furthermore the floating arrangement or container described above may comprise also other auxiliary or management means, such as anti-corrosion arrangement associated with the containers for preventing corrosion of the containers (electric arrangement, noble/base metal pair and/or by a special coating) even if they are not mentioned in greater details in the description.

The invention claimed is:

1. A controlling system for controlling a state of a floating arrangement, wherein the floating arrangement comprises:

at least two interconnected floating standard freight containers configured to form said floating arrangement, and a controllable device for changing a floating state of at least one container of the floating arrangement and thereby the floating state of the floating arrangement, and the controlling system is configured to:

receive state information related to at least one container or the arrangement, compare said received state information to desired state information and based on the comparison provide control information for at least to one controllable device to change state of the of at least one container and thereby the state of the floating arrangement towards said desired state, and operate the controllable device of the float arrangement based on said provided control information in order to achieve said desired state of said floating arrangement.

2. The controlling system of claim 1, wherein the controlling system is configured to receive said control information for controlling said controllable device from an external system of the floating arrangement, or from a manually operated system.

3. The controlling system of claim 1, wherein the floating arrangement further comprises:

a controllable filling device for at least partially filling an inner volume of the container with water-displacing medium, and the controlling system configured to receive state information related to at least one container or the arrangement, compare said received state information to desired state information and based on the comparison provide control information for at least to one controllable device to change state of the arrangement towards said desired state, and operate the controllable device of the float arrangement based on said provided control information to change the capacity of at least one intra-container water-displacing volume or fill an inner volume of the container with water-displacing medium in order to achieve said desired state.

4. The controlling system of claim 1, wherein the controllable device comprises a controlled valve or pump for pumping a fluid into or out of the container or an inflatable bag provided inside a container, or for pumping water into or out of the interior of a container or said inflatable bag provided inside said container.

5. The controlling system of claim 1, wherein at least one container comprises at least two fluid inflatable bags and a pump or a controlled valve as a controllable device for supplying fluid at least into one of the bags or for delivering water into or out of the container and thereby adjusting the state of a container by means of different buoyancies in different parts of the container.

6. The controlling system of claim 1, wherein the container comprises measuring device for measuring the state of the container or intra-container water-displacing volume, and wherein the measurement of the measuring device is configured to be transferred to the controlling system.

7. The controlling system of claim 6, wherein the container, controllable device for measuring the state of the container or intra-container water-displacing volume is selected from a group comprising: a pressure gauge, load gauge, torque force meter, angle meter, and positioning device.

8. The controlling system of claim 6, wherein the container, controllable device or measuring device comprise an ID, whereupon the measurement of the measuring device is configured to be transferred to the controlling system with said ID information representing said state information related to said particular container controllable device, measuring device or the arrangement; or whereupon the controlling system is configured to operate a particular controllable device of the float arrangement based on said ID of said particular controllable device.

9. The controlling system of claim 1, wherein the controllable device comprises an active anchoring system, comprising at least one elongated member having a first point and a second point, the first point being supported at bottom of water by an anchoring device and the second point being coupled with the floating arrangement, wherein the active anchoring system additionally comprises actuating device configured to change a distance of at least one end of the container of the arrangement from the bottom or water surface by actuating said elongated member according to said control information of the controlling system.

10. The controlling system of claim 9, wherein the elongated member comprises a piece of support equipment adapted to be variable in length and fitted between at least one floating container and the anchoring device, by changing whose length the system is adapted to change the state of the arrangement, comprising to change the distance of at least one end of the container, or wherein the elongated member is fixed in length and the actuating device is configured to change position of the at least one end of the container in relation to said fixed elongated member according to said control information of the controlling system.

11. The controlling system of claim 1, wherein the floating arrangement comprises a) weight measuring equipment for determining a weight arriving on or departing from the floating arrangement, b) measuring equipment for draft or a distance to surface, c) measuring equipment for floating arrangement distortion or measuring equipment for wind direction or speed; and wherein said measurement data are configured to be transferred to the controlling system as said state information related to at least one container or the arrangement so that said controlling system is configured to provide said control information for at least to one controllable device to change the state of the arrangement towards said desired state, so as to achieve a desired draft, distance to or inclination of the container or arrangement from the surface.

12. The controlling system of claim 9, wherein in a process of being secured to the bottom, the container is capable of being set at a specific angle by means of said active anchoring system.

13. The controlling system of claim 1, wherein at least one container comprises container moving equipment by means of which the container or several containers or the floating arrangement is or are adapted to be balanced or moved in vertical direction.

14. The controlling system of claim 13, wherein the controlling system is configured to receive a positioning information signal, whereby, in response to the signal, said moving equipment is adapted to be controlled by the controlling system for enabling the floating arrangement either to remain stationary or to shift over a desired distance in a desired direction.

15. The controlling system of claim 1, wherein at least one container is a jetty container disposed at a distance from the floating arrangement and adapted to be linked with one other container of the floating arrangement by way of a shock absorber or a spring.

16. A controlling method for controlling a state of a floating arrangement, wherein the floating arrangement comprises a plurality of interconnected floating standard freight containers, where the floating arrangement comprises controllable device for changing a floating state of at least one container of the floating arrangement and thereby the floating state of the floating arrangement, and wherein the controlling method comprises steps of receiving state information related to at least one container or the floating arrangement, comparing said received state information to desired state information and based on the comparison providing control information for at least to one controllable device to change state of the of at least one container and thereby the state of the floating arrangement towards said desired state, and operating the controllable device of the float arrangement based on said provided control information in order to achieve said desired state of said floating arrangement.

17. The controlling method of claim 16, wherein the controlling system is configured to receive said control information for controlling said controllable device from an external system of the floating arrangement, or from a manually operated system.

18. The controlling method of claim 16, wherein the floating arrangement comprises:

at least one intra-container water-displacing volume in the connection with at least one container, and controllable device for changing capacity of at least one of the intra-container water-displacing volume or the controlling system configured to receive state information related to at least one container or the arrangement, compare said received state information to desired state information and based on the comparison provide control information for at least to one controllable device to change state of the arrangement towards said desired state, and operate the controllable device of the float arrangement based on said provided control information to change the capacity of at least one intra-container water-displacing volume or fill an inner volume of the container with water-displacing medium in order to achieve said desired state of said floating arrangement.

19. A floating arrangement comprising a controlling system for controlling a state of said floating arrangement, wherein the floating arrangement comprises at least two interconnected floating standard freight containers configured to form said floating arrangement, where the floating arrangement comprises controllable device for changing a floating state of at least one container of the floating arrangement and thereby the floating state of the floating arrangement, and the controlling system is configured to:

receive state information related to at least one container or the arrangement, compare said received state information to desired state information and based on the comparison provide control information for at least to one controllable device to change state of the of at least one container and thereby the state of the floating arrangement towards said desired state, and operate the controllable device of the float arrangement based on said provided control information in order to achieve said desired state of said floating arrangement, wherein said arrangement is a harbor arrangement, a bridge arrangement, a logistics arrangement, a flight support arrangement or military or social infrastructural arrangement, a jetty, a utility work machine platform, a drilling derrick, a bridge building site, a temporary structure, a pontoon bridge or a bridge support structure.

20. A floating arrangement of claim 19, further comprising at least one anchoring container and at least one stabilizing container, the buoyancy of which is controllable by the controlling system to stabilize the floating arrangement.

* * * * *